US009069370B2

(12) United States Patent
Soenen et al.

(10) Patent No.: US 9,069,370 B2
(45) Date of Patent: Jun. 30, 2015

(54) DIGITAL LOW DROP-OUT REGULATOR

(71) Applicant: TAIWAN SEMICONDUCTOR MANUFACTURING COMPANY, LTD., Hsinchu (TW)

(72) Inventors: Eric Soenen, Austin, TX (US); Alan Roth, Leander, TX (US)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 130 days.

(21) Appl. No.: 13/837,973

(22) Filed: Mar. 15, 2013

(65) Prior Publication Data

US 2014/0002041 A1 Jan. 2, 2014

Related U.S. Application Data

(60) Provisional application No. 61/666,737, filed on Jun. 29, 2012.

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
USPC ..... 323/271, 273, 281, 282, 283
See application file for complete search history.

(56) References Cited

U.S. PATENT DOCUMENTS

| | | | | |
|---|---|---|---|---|
| 6,946,823 | B2 * | 9/2005 | Huang et al. | 323/282 |
| 7,203,079 | B2 * | 4/2007 | Yang et al. | 363/41 |
| 7,759,911 | B2 * | 7/2010 | Omi | 323/222 |
| 2009/0219000 | A1 * | 9/2009 | Yang | 323/282 |
| 2013/0176009 | A1 * | 7/2013 | Yang et al. | 323/274 |

* cited by examiner

*Primary Examiner* — Emily P Pham
(74) *Attorney, Agent, or Firm* — Lowe Hauptman & Ham, LLP

(57) ABSTRACT

A low drop-out regulator circuit includes a control circuit and a switching device. The control circuit has an output node. The switching device has a first terminal coupled with the output node of the control circuit. The switching device is configured to receive an input voltage at a second terminal of the switching device and provide an output voltage at a third terminal of the switching device. The control circuit is configured to provide a digital signal at the output node of the control circuit based on a feedback voltage of the output voltage at the third terminal of the switching device.

21 Claims, 3 Drawing Sheets

DIGITAL LOW DROP-OUT REGULATOR

CROSS-REFERENCE TO RELATED APPLICATION

The present application claims the priority of U.S. Provisional Application No. 61/666,767, filed Jun. 29, 2012, the disclosure of which is enclosed herein in its entirety.

FIELD

The present disclosure is related to a digital low drop-out regulator (DLDO).

BACKGROUND

Low drop-out regulators (LDOs) refer to direct current (DC) voltage regulators or converters. Existing voltage regulators are complex, hard to design, and costly. For example, in an approach of an inductor based DC-DC voltage converter, both an inductor and a capacitor are used. The voltage converter provides high efficiency, but requires a large die area, and is therefore expensive.

In another approach of a continuous time LDO, a large power transistor and a compensation capacitor are used. The LDO provides a continuous output, but has lower efficiency. Additionally, circuit stability of the LDO is hard to control when the loads of the LDO vary.

BRIEF DESCRIPTION OF THE DRAWINGS

The details of one or more embodiments of the disclosure are set forth in the accompanying drawings and the description below. Other features and advantages will be apparent from the description, drawings, and claims.

Like reference symbols in the various drawings indicate like elements.

DETAILED DESCRIPTION

Figure 1:
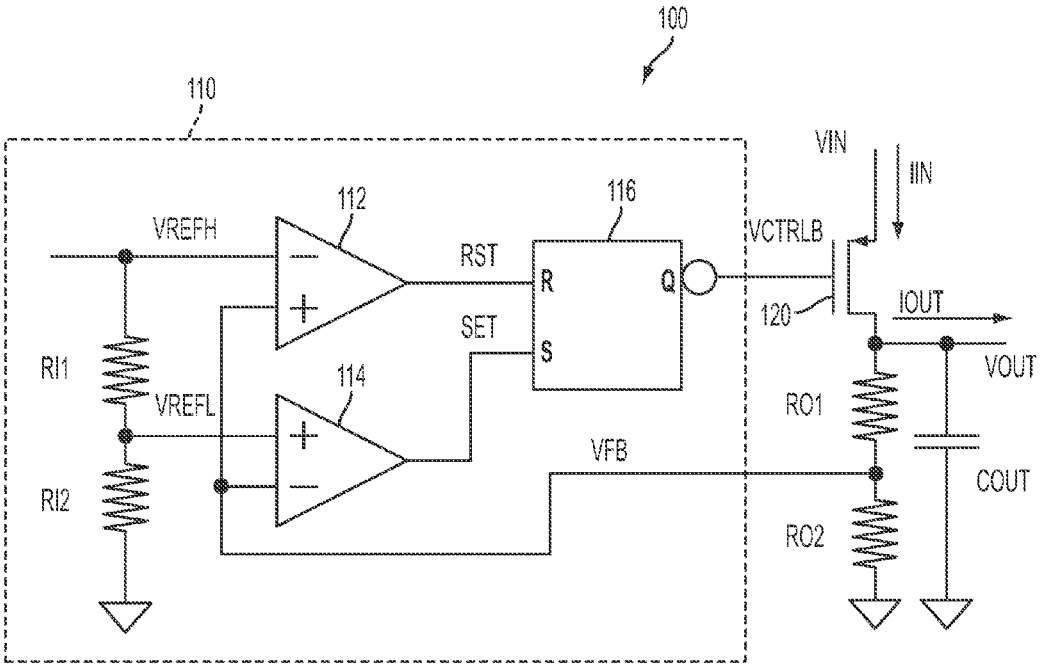
FIG. 1 is a diagram of a digital low drop-out regulator (DLDO), in accordance with some embodiments.

Embodiments, or examples, illustrated in the drawings are disclosed below using specific language. It will nevertheless be understood that the embodiments and examples are not intended to be limiting. Any alterations and modifications in the disclosed embodiments, and any further applications of the principles disclosed in this document are contemplated as would normally occur to one of ordinary skill in the pertinent art.

Some embodiments have one or a combination of the following features and/or advantages. In various embodiments, a switching power transistor in a low-dropout regulator (LDO) is controlled by a digital signal. The LDO is therefore called a digital LDO (DLDO). In some embodiments, one switching power transistor is used. When the switching power transistor is turned on, current is delivered to a load of the DLDO through the switching power transistor. In contrast, when the switching power transistor is turned off, the DLDO draws no current. As a result, the design of the DLDO is highly simplified. The DLDO provides a fast response, is more robust than LDOs in other approaches, and is easy to be integrated with other electrical components or circuits in advanced manufacturing processes. The DLDO is unconditionally stable, and thus highly reliable.

Digital Low Drop-Out Regulator Circuit, Some Embodiments

FIG. 1 is a diagram of a digital low drop-out regulator (DLDO) 100, in accordance with some embodiments. For simplicity, throughout this document, a reference name is used for both a node or a line and a signal or a voltage on the node or the line. For example, VOUT is used to refer to an output node of DLDO 100, and a signal and a voltage on the node.

DLDO 100 receives a voltage VIN at a source of a switching power transistor 120 and regulates voltage VIN to provide a voltage VOUT at a drain of transistor 120. In some embodiments, voltage VOUT is reduced from voltage VIN based on a power dissipation of switching power transistor 120. Sizes of transistor 120 are selected to cause an appropriate amount of power dissipation and thus and amount of voltage reduction from voltage VIN to voltage VOUT. A control circuit 110 is used to control transistor 120. In some embodiments, voltage VIN has a DC voltage of about 3.6 V and is from a battery source while voltage VOUT has a DC voltage of about 1.1 V for use in microprocessors in smart phones, for example.

A resistor RO1 is coupled in series with a resistor RO2 and with the drain of transistor 120. Resistors RO1 and RO2 function as a voltage divider that scales down a DC voltage VOUT to result in a feedback voltage VFB at a node between resistors RO1 and RO2. In other words, voltage VFB is lower than voltage VOUT. In some embodiments, feedback voltage VFB is scaled down from voltage VOUT to be compared with available lower reference voltages, to be used in a lower voltage domain, etc. Feedback voltage VFB is then used by comparators 112 and 114 in their comparison operations. For simplicity, output voltage VOUT is used for illustrations in the comparison operations of comparators 112 and 114. Stated differently, for purpose of analysis feedback voltage VFB is assumed to be the same as output voltage VOUT (i.e., without attenuation).

Resistors RI1 and RI2 function as a voltage divider that receives a high reference voltage VREFH at a negative terminal (−) of comparator 112, and provides a low reference voltage VREFL at a node between resistors RI1 and RI2. A positive terminal (+) of comparator 114 receives voltage VREFL. In some embodiments, reference voltage VREFH is from a voltage source external to circuit 110. In some embodiments, reference voltage VREFH is a little higher than the desired voltage VOUT and reference voltage VREFL is a little lower than the desired voltage VOUT. For example, when voltage VOUT is about 1.1 V, voltage VFB is about 1.1 V, reference voltage VREFH is about 1.11 V while reference voltage VREFL is about 1.09 V. Effectively, reference voltage VREFL sets a low limit for a voltage range and reference voltage VREFH sets a high limit for the same voltage range, and voltage VOUT switches within that voltage range. As a result, in the embodiments that voltage VOUT is about 1.1V DC, voltage VOUT switches between the high reference voltage VREFH of about 1.11 V and the low reference voltage VREFL of about 1.09 V.

In embodiments where voltage VOUT is scaled down, reference voltages VREFH and VREFL are scaled down accordingly. For example, when voltage VOUT is scaled down to voltage VFB of about 0.55 V, voltages VREFH and VREFL are set to about 0.575 V and 0.475 V, respectively.

The above values for reference voltages VREFH and VREFL and feedback voltage VFB are for illustration. Different values for reference voltages VREFH and VREFL and feedback voltage VFB are within the scope of various embodiments.

Comparator 112 receives reference voltage VREFH at a negative terminal and feedback voltage VFB at a positive terminal, and generates a reset signal RST at an output terminal. For example, if voltage VFB is higher than reference voltage VREFH, comparator 112 provides a logical high value to signal RST. In contrast, if voltage VFB is lower than reference voltage VREFH, comparator 112 provides a low logical value to signal RST.

Comparator 114 receives reference voltage VREFL at a positive terminal and feedback voltage VFB at a negative terminal, and generates set signal SET at an output terminal. For example, if voltage VFB is lower than reference voltage VREFL, comparator 114 provides a high logical value to signal SET. But when voltage VFB is higher than reference voltage VREFL, comparator 114 provides a low logical value to signal SET.

An RS flip-flop 116 receives reset signal RST at an R terminal and set signal SET at an S terminal, and generates a signal VCTRLB at an output Q terminal. For example, when reset signal RST is logical high, signal VCTRLB is reset to a high logical value. In contrast, when set signal SET is logically high, signal VCTRLB is set to a low logical value. Effectively, signal VCTRLB is set to a logical low value when voltage VFB is lower than the low reference voltage VREFL, and is reset to a logical high value when voltage VFB is higher than the high reference voltage VREFH. In other words, signal VCTRLB is set when voltage VOUT is lower than the low reference voltage VREFL, and is reset when voltage VOUT is higher than the high reference voltage VREFH.

P-type metal oxide semiconductor (PMOS) transistor 120 is sometimes called a switching power transistor. Signal VCTRLB at a gate of transistor 120 turns on and off transistor 120. For example, when signal VCTRLB is logically high, transistor 120 is turned off. But when signal VCTRLB is logically low, transistor 120 is turned on. A source of transistor 120 receives input voltage VIN, and a drain of transistor 120 serves as output VOUT. When transistor 120 is turned on, the combination of input voltage VIN and transistor 120 acts as a current source sourcing current IIN to supply current IOUT to capacitor COUT and a load (not shown) of DLDO 100.

Current IOUT flows from a drain of transistor 120 through the load of DLDO 100. In some embodiments, current IIN is higher than current IOUT such that when voltage VOUT is lower than the low reference voltage VREFL, capacitor COUT is charged and voltage VOUT increases.

Capacitor COUT is coupled to node VOUT and serves to store energy in electrical charge for node VOUT. Capacitor COUT minimizes the ripple of signal VOUT. Capacitor COUT may be considered part of DLDO 100 or part of the load of DLDO 100. Various embodiments of the disclosure are not limited by the location of capacitor COUT.

In some embodiments, at a time when transistor 120 starts to turn on, voltage VFB is lower than the low reference voltage VREFL. One part of current IIN at the source of transistor 120 flows to the drain of transistor 120 and generates current IOUT to be used by the load of DLDO 100. Another part of current IIN charges capacitor COUT. As a result, voltage VOUT starts to increase. The rate at which voltage VOUT increases depends on the size of capacitor COUT and on the value of current IIN, which depends on the size of transistor 120. For example, when current IIN has a high value and transistor 120 is thus large, voltage VOUT increases at a faster rate. But when current IIN has a lower value and transistor 120 is thus small, voltage VOUT increases at a slower rate. Current IOUT also causes electrical charge to be stored in capacitor COUT.

When voltage VOUT is higher than the high reference voltage VREFH, transistor 120 is turned off, and there is no current flowing from the source to the drain of transistor 120. As a result, electrical charge from capacitor COUT is discharged by the power consumed by the load of DLDO 100. Stated differently, capacitor COUT sources a current for voltage VOUT. Consequently, voltage VOUT starts to decrease until voltage VFB is lower than the low reference voltage VREFL. At that time, transistor 120 is turned on, and voltage VOUT starts to increase again. Effectively, voltage VOUT as represented by voltage VFB has a DC component and an alternating current (AC) component that switches between reference voltages VREFL and VREFH. Expressed differently, the AC component of voltage VOUT is switching at a frequency at which transistor 120 is turned on and off. Further, because transistor 120 is turned on and off, current IIN flows and stops flowing accordingly. As a result, current IIN is pulsing. DLDO 100 is therefore also called a pulsed current regulator in some applications.

Signal VCTRLB is considered oscillating in a pulse width modulation (PWM) manner, which in turn modulates the current through transistor 120 in a pulse width modulation manner. The average current through transistor 120 can be calculated by taking the on current, which is approximately constant, and multiplying it by the ratio of the on time of transistor 120 to the sum of the on and off times. The ratio of the on time to the sum of the on and off times is often referred to as the duty cycle, D. The relationship between input current IIN when transistor 120 is on and output current IOUT can be mathematically expressed as:

$$D = IOUT/IIN$$

Digital Low Drop-Out Regulator Circuit, Some Further Embodiments

Figure 2:
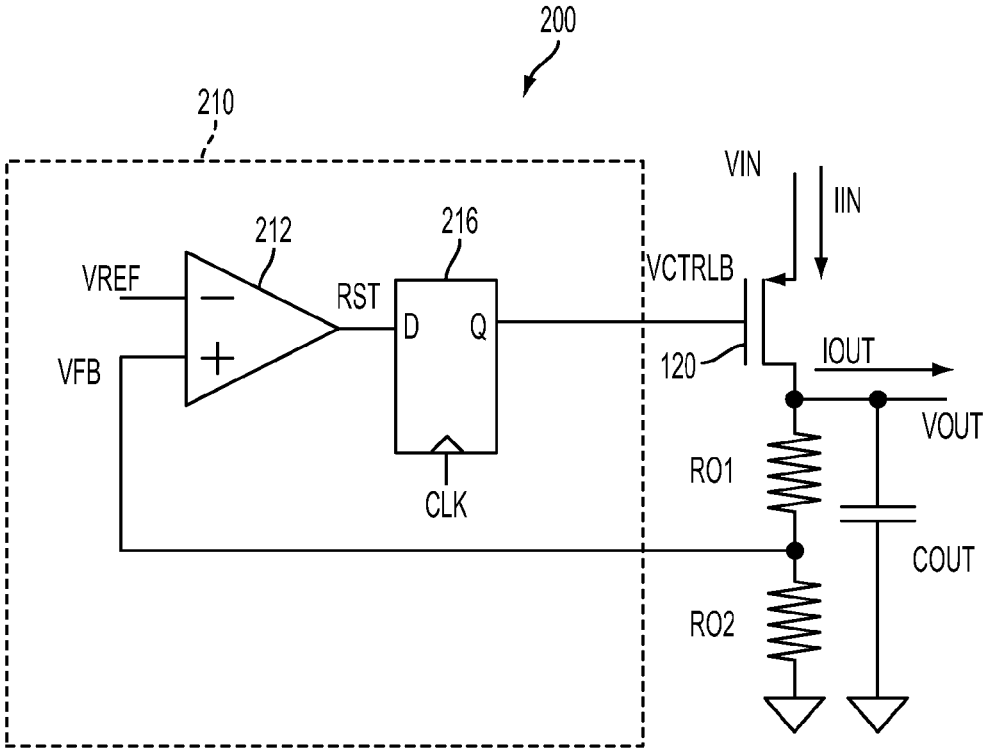
FIG. 2 is a diagram of a DLDO, in accordance with some further embodiments.

FIG. 2 is a diagram of a DLDO 200, in accordance with some embodiments. Compared with DLDO 100 in FIG. 1, DLDO 200 includes a control circuit 210 different from control circuit 110 in FIG. 1. For illustration as in the case of DLDO 100, voltage VFB for DLDO 200 is the same as voltage VOUT.

Control circuit 210 includes a comparator 212 and a D flip-flop 216 operating with a clock signal CLK. DLDO 200 is called synchronous because signal VCTRLB in DLDO 200 is generated based on clock signal CLK. In contrast, DLDO 100 is called asynchronous because signal VCTRLB in DLDO 100 is generated, but not based on any clock signal.

Comparator 212 receives a reference voltage VREF at the negative terminal and feedback voltage VFB at the positive terminal, and generates a reset signal RST at the output terminal. When voltage VFB is higher than reference voltage VREF, comparator 212 generates signal RST having a high logical value. But if voltage VFB is lower than reference voltage VREF, comparator 212 generates signal RST having a low logical value.

A D-input of D flip-flop 216 receives signal RST. A clock input of D flip-flop 216 receives clock signal CLK. A Q-output of D flip-flop 216 provides signal VCTRLB.

D flip-flop 216 generates output signal VCTRLB based on input signal RST and clock signal CLK. For example, at each rising edge of clock signal CLK, if signal RST is logically low, signal VCTRLB is logically low. But if signal RST is logically high, signal VCTRLB is also logically high. In some embodiments, based on feedback voltage VFB, comparator 212 generates reset signal RST having alternating low and high logical values. As a result, at each rising edge of clock signal CLK, D flip-flop 216 generates signal VCTRLB having alternating low and high logical values. Consequently, transistor 120 can be turned on or off at each rising edge of clock signal CLK. In other words, transistor 120 is turned on or off in a way that is synchronous with clock signal CLK.

In some embodiments, when voltage VFB is higher than reference voltage VREF, transistor 120 is turned off, and electrical energy from capacitor COUT provides a current for voltage VOUT. Whether or not voltage VFB is higher than reference voltage VREF is determined by comparator 212. When transistor 120 is turned off, electrical charge in capacitor COUT is discharged and causes voltage VOUT to decrease. In contrast, when voltage VOUT through voltage VFB is lower than reference voltage VREF, transistor 120 is turned on. Whether or not voltage VFB is lower than reference voltage VREF is determined by comparator 212. When transistor 120 is turned on, current IIN flows through transistor 120 to provide current IOUT for voltage VOUT, and causes voltage VOUT to increase. A portion of current IIN becomes electrical charge stored in capacitor COUT. In some embodiments, voltage VOUT as represented by voltage VFB fluctuates around reference voltage VREF. Signal VCTRLB, however, does not change the logical value until at each rising edge of clock signal CLK. Stated in a different way, signal VCTRLB switches between a high and a low logical value in a way synchronous with clock signal CLK. Signal VCTRLB in DLDO 200 is considered oscillating in a pulse density modulation (PDM) manner because the number of negative pulses of signal VCTRLB per unit of time determines the proportion of the time transistor 120 is on. The term PDM is commonly used for situations where pulses can occur or not occur and the length of each pulse is constant. Further, because transistor 120 is turned on and off, current IIN flows and stops flowing accordingly. The density of pulses turning transistor 120 on determines the average current in transistor 120. Current IIN is therefore pulsing, and DLDO 200 is also called a pulsed current regulator.

In both DLDOs 100 and 200, power switching transistor 120 is controlled by a digital voltage VCTRLB, and a fixed output voltage VOUT is generated from a varying input VIN. No compensation capacitors or inductors are used. A die size of each DLDO 100 and 200 is therefore small compared to that of other approaches. Capacitor COUT does not cause instability of corresponding DLDO by operations of capacitor COUT working in DLDOs 100 and 200. This is because DLDOs 100 and 200 each use one current source and one output capacitor, such as capacitor COUT. For example, output voltage VOUT is determined by integrating current IOUT on capacitor COUT, and therefore forms a first order system. When used with feedback, such as feedback signal VFB, a first order system DLDO 100 or 200 is stable. DLDOs 100 and 200 are applicable for systems on a chip and advance manufacturing process nodes, such as 20 nm, 14 nm, etc.

PMOS transistor 120 used in DLDOs 100 and 200 are for illustration. Other switching devices, circuits, or mechanisms are within the scope of various embodiments. Mechanical micro switches are examples of switching devices. Examples of switching transistors include an N-type MOS (NMOS) transistor, a junction field effect transistor (JFET), a metal field effect transistor (MESFET), a bipolar junction transistor (BJT), an insulated gate bipolar transistor (IGBT), etc. When a switching mechanism is used in place of PMOS transistor 120, signal VCTRLB is adjusted accordingly. For example, if an NMOS transistor is used in place of PMOS transistor 120 in DLDO 100, a gate of the NMOS transistor receives a signal VCTRL (not labeled), a drain of the NMOS transistor receives voltage VIN, and a source of the NMOS transistor functions as output node VOUT. In such a situation, signal VCTRL is a logical inverse of signal VCTRLB, and is adjusted to be at least a threshold voltage of the NMOS transistor higher than voltage VOUT to turn on the NMOS transistor.

Exemplary Method

Figure 3:
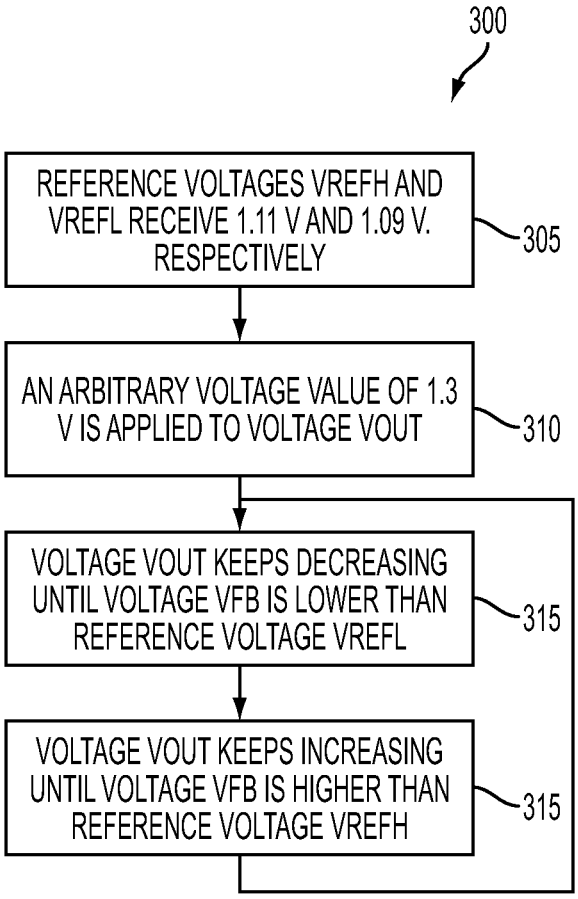
FIG. 3 is a flowchart of a method illustrating an operation of the DLDO in FIG. 1, in accordance with some embodiments.

FIG. 3 is a flowchart of a method 300 of operating DLDO 100, in accordance with some embodiments. In various embodiments, voltage values of voltage VIN and VOUT are known. For example, voltage VIN is about 3.6 V and voltage VOUT is about 1.1 V. Reference voltage VREFH is selected to be a little higher than the desired value of voltage VOUT, and reference voltage VREFL is selected to be a little lower than the desired value of voltage VOUT. For example, reference voltage VREFH is selected to be about 1.11 V, and reference voltage VREFL is selected to be about 1.09 V. Resistors RI1 and RI2 are selected accordingly to generate reference voltage VREFL based on reference voltage VREFH.

In operation 305, reference voltages VREFH and VREFL receive 1.11 V and 1.09 V, respectively.

In operation 310, transistor 120 is in an off state. An arbitrary voltage value higher than voltage VOUT of 1.1 V is applied to voltage VOUT. For illustration, the arbitrary voltage is 1.3 V. Voltage VOUT starts to decrease because the load of DLDO 100 draws current IOUT.

In operation 315, voltage VOUT keeps decreasing until voltage VFB is lower than reference voltage VREFL. When comparator 114 recognizes voltage VFB (or voltage VOUT) is lower than reference voltage VREFL of 1.09 V, comparator 114 provides a logical high value to signal SET. As a result, flip-flop 116 generates a low logical value for signal VCTRLB. Transistor 120 is therefore turned on. Voltage VOUT starts to increase. The initial value for voltage VOUT described herein is for illustration. In some embodiments, operation 315 is omitted.

In operation 320, voltage VOUT keeps increasing until voltage VFB is higher than reference voltage VREFH. When comparator 112 recognizes that voltage VFB, or voltage VOUT, is higher than reference voltage VREFH, comparator 112 generates a high logical value to signal RST. As a result, flip-flop 116 generates a high logical value for signal VCTRLB. Transistor 120 is therefore turned off. Voltage VOUT starts to decrease until voltage VFB is lower than reference voltage VREFL. From this time on, voltage VOUT keeps decreasing and increasing in accordance with operations 315 and 320. In other words, signal VCTRLB switches between a high and a low logical value. At the same time, transistor 120 is alternatingly turned on and off, and the AC component of voltage VFB switches within reference voltages VREFL and VREFH at the same frequency as transistor 120 is turned on and off.

With respect to DLDO 200 in FIG. 2, the above operations in method 300 are similar except that reference voltage VREF is selected to be equal to the desired value of voltage VFB, and operations 315 and 320 vary accordingly. For example, in operation 315, as soon as comparator 212 recognizes that voltage VFB is higher than voltage VREF, comparator 212 provides a high logical value to signal RST. Flip-flop 216, however, does not update a logic state of signal VCTRLB until the next rising edge of clock signal CLK. As a result, transistor 120 is not turned off until the next rising edge of clock signal CLK. During the time signal RST starts to become logically high until the next rising edge of clock signal CLK, voltage VOUT continues to decrease. To limit the amount of voltage VOUT being decreased within an acceptable range, a frequency of clock signal CLK is selected accordingly. Similarly, in operation 320, as soon as comparator 212 recognizes that voltage VFB is lower than voltage VREF, comparator 212 provides a low logical to signal RST. Flip-flop 216, however, does not provide a low logical value to signal VCTRLB until the next rising edge of clock signal CLK. Transistor 120 is therefore not turned on until the next rising edge of clock signal CLK. During the time signal RST starts to become logically low until the next rising edge of clock signal CLK, voltage VOUT continues to increase. To limit the amount of voltage VOUT being increased within an acceptable range, a frequency of clock signal CLK is selected accordingly. Effectively, signal VCTRLB switches between a low and a high logical value in accordance with clock signal CLK. Similarly, transistor 120 is turned on and off in accordance with clock signal CLK. The AC component of voltage VOUT has a frequency being the same as the frequency of clock signal CLK.

In some embodiments, a low drop-out regulator circuit includes a control circuit and a switching device. The control circuit has an output node. The switching device has a first terminal coupled with the output node of the control circuit. The switching device is configured to receive an input voltage at a second terminal of the switching device and provide an output voltage at a third terminal of the switching device. The control circuit is configured to provide a digital signal at the output node of the control circuit based on a feedback voltage of the output voltage at the third terminal of the switching device.

In some embodiments, a digital signal is generated based on a feedback voltage. The digital signal is applied to a first terminal of a switching device to cause the switching device to turn on and off based on corresponding logical values of the digital signal. The switching device receives an input voltage at a second terminal of the switching device and generates an output voltage at a third terminal of the switching device. The feedback voltage is generated based on the output voltage.

In some embodiments, a low drop-out regulator circuit comprises a control circuit and a switching device. The control circuit has an output node. The switching device has a first terminal coupled with the output node. The transistor is configured to receive an input voltage at a second terminal of the switching device and provide an output voltage at a third terminal of the switching device. The control circuit includes a first comparator and a flip-flop. The first comparator is configured to receive a first reference voltage at a first terminal of the first comparator and to receive a feedback voltage at a second terminal of the first comparator. The flip-flop is configured to receive an output signal of the first comparator and generate a flip-flop output signal at the output node of the control circuit to control the switching device.

A number of embodiments have been described. It will nevertheless be understood that various modifications may be made without departing from the spirit and scope of the disclosure. For example, various transistors being shown as a particular dopant type (e.g., N-type or P-type Metal Oxide Semiconductor (NMOS or PMOS)) are for illustration purposes. Embodiments of the disclosure are not limited to a particular type. Selecting different dopant types for a particular transistor is within the scope of various embodiments. The low or high logical value of various signals used in the above description is also for illustration. Various embodiments are not limited to a particular value when a signal is activated and/or deactivated. Selecting different levels is within the scope of various embodiments. In various embodiments, a transistor functions as a switch. A switching circuit used in place of a transistor is within the scope of various embodiments.

Various figures showing discrete resistors are for illustration. Equivalent circuitry may be used. For example, a resistive device, circuitry or network (e.g., a combination of resistors, resistive devices, circuitry, etc.) can be used in place of the resistor.

The above illustrations include exemplary steps, but the steps are not necessarily performed in the order shown. Steps may be added, replaced, changed order, and/or eliminated as appropriate, in accordance with the spirit and scope of disclosed embodiments.

What is claimed is:

1. A low drop-out regulator circuit comprising:
a control circuit having an output node; and
a switching device having a first terminal coupled with the output node of the control circuit,
wherein
the switching device is a transistor;
the switching device is configured to receive an input voltage at a second terminal of the switching device and provide an output voltage at a third terminal of the switching device; and
the control circuit comprises:
a first comparator configured to generate a first-comparator output signal based on comparing a first predetermined reference voltage and a feedback voltage, the feedback voltage being a scaled representative of the output voltage at the third terminal of the switching device; and
a flip flop configured to generate a digital signal at the output node of the control circuit based on the first-comparator output signal.

2. The low drop-out regulator circuit of claim 1, wherein
the control circuit is configured to provide the digital signal as a pulse width modulation signal or as a pulse density modulation signal.

3. The low drop-out regulator circuit of claim 1, wherein
the control circuit is configured to provide the digital signal as an asynchronous digital signal or as a synchronous digital signal.

4. The low drop-out regulator circuit of claim 1, wherein
the control circuit is configured to receive the first predetermined reference voltage and a second predetermined reference voltage; and
the control circuit is configured to compare the feedback voltage against the first predetermined reference voltage and the second predetermined reference voltage to result in the digital signal.

5. The low drop-out regulator circuit of claim 1, wherein
the control circuit comprises a second comparator;
the second comparator is configured to receive a second predetermined reference voltage and the feedback voltage, and generate a second-comparator output signal based on a comparison between the second predetermined reference voltage and the feedback voltage; and
the flip-flop is configured to receive the first-comparator output signal and the second-comparator output signal, and generate the digital signal based on the first-comparator output signal and the second-comparator output signal.

6. The low drop-out regulator circuit of claim 1, wherein the control circuit comprises a second comparator;

the flip flop is an RS flip-flop;

the first comparator is configured to receive the first predetermined reference voltage at a negative terminal of the first comparator and the feedback voltage at a positive terminal of the first comparator, and generate the first-comparator output signal based on a comparison between the first predetermined reference voltage and the feedback voltage;

the second comparator is configured to receive a second predetermined reference voltage at a positive terminal of the second comparator and the feedback voltage at a negative terminal of the second comparator, and generate a second-comparator output signal based on a comparison between the second predetermined reference voltage and the feedback voltage; and the RS flip-flop is configured to receive the first-comparator output signal at a first input terminal of the RS flip-flop and the second-comparator output signal at a second input terminal of the RS flip-flop, and generate the digital signal at an output terminal of the RS flip-flop.

7. The low drop-out regulator circuit of claim 1, wherein the low drop-out regulator circuit is configured to meet at least one of a first set of conditions or a second set of conditions;

the first set of conditions includes the low drop-out regulator circuit further comprising a first voltage divider configured to generate the feedback voltage from the output voltage at the third terminal of the switching device; and the second set of conditions includes the low drop-out regulator circuit further comprising a second voltage divider configured to generate a second predetermined reference voltage from the first predetermined reference voltage.

8. The low drop-out regulator circuit of claim 1, wherein the flip-flop is configured to receive the first-comparator output signal and a clock signal, and generate the digital signal based on the first-comparator output signal and the clock signal.

9. The low drop-out regulator circuit of claim 1, wherein the flip flop is a D flip-flop;

the first comparator is configured to receive the first predetermined reference voltage at a negative terminal of the first comparator and the feedback voltage at a positive terminal of the first comparator, and generate the first-comparator output signal based on a comparison between the predetermined reference voltage and the feedback voltage; and the D flip-flop is configured to receive the first-comparator output signal at a "D" terminal of the D flip-flop and receive a clock signal at a clock terminal of the D flip-flop, and generate the digital signal at an output terminal of the D flip-flop.

10. A method comprising:

generating a digital signal based on a feedback voltage, comprising:

generating one or more comparison signals by comparing the feedback voltage against one or more corresponding predetermined reference voltages; and generating, by a flip-flop, the digital signal based on the one or more comparison signals;

applying the digital signal to a first terminal of a transistor to cause the transistor to turn on and off based on corresponding logical values of the digital signal;

the transistor receiving an input voltage at a second terminal of the transistor and generating an output voltage at a third terminal of the transistor; and generating the feedback voltage based on the output voltage, the feedback voltage being a scaled representative of the output voltage.

11. The method of claim 10, wherein the flip-flop is a D flip-flop; and generating the digital signal comprises:

receiving one of the one or more comparison signals at a "D" terminal of the D flip-flop.

12. The method of claim 10, wherein generating the digital signal comprises generating a pulse width modulation signal or generating a pulse density modulation signal.

13. The method of claim 10, wherein generating the digital signal comprises generating an asynchronous digital signal or generating a synchronous digital signal.

14. The method of claim 10, wherein the output voltage has a direct-current component and an alternating-current component; and the alternating-current component is switching at a frequency at which the transistor is turned on and turned off or at a frequency of a clock signal used to generate the digital signal.

15. The method of claim 10, wherein the flip-flop is an RS flip-flop; and generating the digital signal comprises:

receiving a first one of the one or more comparison signals at an "R" terminal of the RS flip-flop; and receiving a second one of the one or more comparison signals at an "S" terminal of the RS flip-flop.

16. A low drop-out regulator circuit comprising:

a control circuit having an output node; and a transistor having a first terminal coupled with the output node, wherein the transistor is configured to receive an input voltage at a second terminal of the transistor and provide an output voltage at a third terminal of the transistor; and the control circuit includes a first comparator configured to receive a first predetermined reference voltage at a first terminal of the first comparator and a feedback voltage at a second terminal of the first comparator, the feedback voltage being a scaled representative of the output voltage; and a flip-flop configured to receive an output signal of the first comparator and generate a flip-flop output signal at the output node of the control circuit to control the transistor.

17. The low drop-out regulator circuit of claim 16, wherein the first comparator is configured to receive the first predetermined reference voltage at a negative terminal of the first comparator and the feedback voltage at a positive terminal of the first comparator;

the low drop-out regulator circuit further comprises a second comparator;

the second comparator is configured to receive a second predetermined reference voltage at a positive terminal of the second comparator and to receive the feedback voltage at a negative terminal of the second comparator; and the flip-flop is an RS flip-flop configured to further receive an output signal of the second comparator, and generate the flip-flop output signal based on the output of the first comparator and the output signal of the second comparator.

18. The low drop-out regulator circuit of claim 16, wherein the low drop-out regulator circuit is configured to meet at least one of a first set of conditions or a second set of conditions;

the first set of conditions includes the low drop-out regulator circuit further comprising a first voltage divider configured to generate the feedback voltage from the output voltage at the third terminal of the switching device; and the second set of conditions includes the low drop-out regulator circuit further comprising a second voltage divider configured to generate a second predetermined reference voltage from the first predetermined reference voltage.

19. The low drop-out circuit of claim 16, wherein the flip-flop is configured to generate the flip-flop output signal as an asynchronous digital signal or as a synchronous digital signal.

20. The low drop-out circuit of claim 16, wherein the flip-flop is configured to generate the flip-flop output signal as a pulse width modulation signal or as a pulse density modulation signal.

21. The low drop-out regulator circuit of claim 16, wherein the first comparator is configured to receive the first predetermined reference voltage at a negative terminal of the first comparator and to receive the feedback voltage at a positive terminal of the first comparator; and the flip-flop is a D flip-flop configured to further receive a clock signal, and generate the flip-flop output signal based on the output signal of the first comparator and the clock signal.

* * * * *